United States Patent [19]

Bendiks

[11] Patent Number: 4,845,376

[45] Date of Patent: Jul. 4, 1989

[54] BUOYANT GAS ACTIVATED HYDROELECTRIC GENERATOR

[76] Inventor: Donald J. Bendiks, 2323 Normandy, #1-C, Michigan City, Ind. 46360

[21] Appl. No.: 145,576

[22] Filed: Jan. 19, 1988

[51] Int. Cl.[4] ..... F03B 13/00

[52] U.S. Cl. ..... 290/54; 60/398; 290/1 R

[58] Field of Search ..... 290/54, 43, 1 R, 53; 60/398; 415/DIG. 2

[56] References Cited

U.S. PATENT DOCUMENTS

| | | | |
|---|---|---|---|
| 3,536,929 | 10/1970 | Parker | 290/1 R |
| 3,939,356 | 2/1976 | Loane | 290/54 X |
| 4,103,490 | 8/1978 | Gorlov | 60/398 |
| 4,258,269 | 3/1981 | Tsubota | 290/53 |
| 4,508,971 | 4/1985 | Bailey | 290/54 X |
| 4,514,977 | 5/1985 | Bowen | 60/398 |
| 4,691,115 | 9/1987 | Robinson | 290/54 X |
| 4,698,516 | 10/1987 | Thompson | 290/54 |
| 4,739,182 | 4/1988 | Kendri | 290/54 |

*Primary Examiner*—William M. Shoop, Jr.
*Assistant Examiner*—Sharon D. Logan
*Attorney, Agent, or Firm*—James D. Hall; Thomas J. Dodd; Todd A. Dawson

[57] ABSTRACT

A self contained hydroelectric generator which includes two fluid tanks mutually connected to a turbine generator. A volume of fluid is transferred between the tanks by either an elevator or a weight positioned within the first fluid tank. The elevator or weight is raised and lowered by inflating and deflating low density gas balloons connected thereto. As the elevator or weight is lifted by the inflated balloons, fluid is transferred from the first tank into the second tank. As the fluid moves from one tank to the other through the turbine generator, the turbines impellers rotate to cause the generator's armature to rotate within a magnetic field to produce electricity.

4 Claims, 3 Drawing Sheets

BUOYANT GAS ACTIVATED HYDROELECTRIC GENERATOR

SUMMARY OF THE INVENTION

This invention relates to hydroelectric generators, and has special application to a generator which is activated by a fluid flowing through a conduit.

Heretofore, hydroelectric generators have required a continuously renewing source of water or other fluids to rotate the impellers of the turbines used to generate electricity. Such requirement has caused industry and the government to build huge dams to store water for subsequent release in controlled amounts through the turbines. One obvious problem associated with such generation methods is the enormous cost associated with building a hydroelectric dam. A further problem is that this method is impractical in areas removed from a flowing water source.

This invention eliminates the above problems by providing for a totally self contained hydroelectric generator. The fluid source (usually water) is contained within a large tank. Water flow through the generator turbine is established either by elevating a volume of water and releasing it in a controlled amount through the turbine or, by transferring the water between two horizontally aligned tanks via a conduit which is in flow communication with the turbine.

The elevation of water is accomplished by connecting a platform to a balloon which is filled with a low density or buoyant gas, such as helium or the like. Upon inflation of the balloon the platform is lifted to elevate a volume of water to a holding tank which is in flow communication with the turbine generator.

In a similar fashion, water may be transferred between the two horizontally aligned tanks by raising or lowering a weighted plunger housed within one tank responsive to inflation and deflation of one or more balloons.

Accordingly, it is an object of this invention to provide for a self-contained hydroelectric generator.

Another object of this invention is to provide for a selfcontained hydroelectric generator which uses balloons filled with buoyant gas to transfer volumes of fluids through a turbine generator.

Further objects of this invention will become apparent upon a reading of the description below taken along with the accompanying drawings.

DESCRIPTION OF THE PREFERRED EMBODIMENTS

The preferred embodiments described below are not intended to be exhaustive or to limit the invention to the precise forms disclosed. They are chosen and described to explain the principles of the invention and its application and practical use to enable others skilled in the art to utilize the invention.

Figure 1:
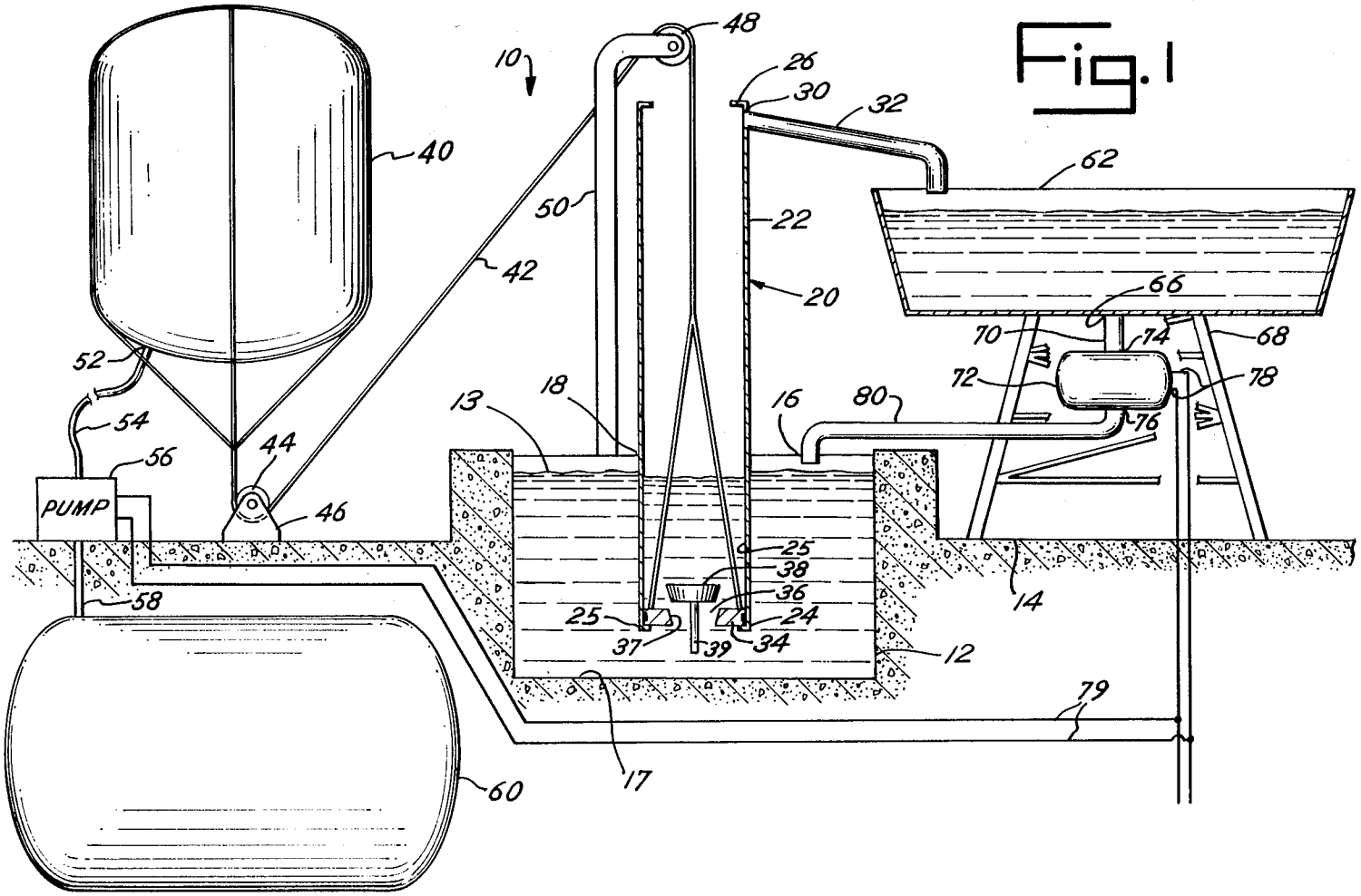
FIG. 1 is an elevational view of a first embodiment of the invention with some elements shown in cross-section for illustrative purposes.

Referring now to FIG. 1, apparatus 10 having a main water storage reservoir 12 is illustrated. Reservoir 12 is positioned substantially beneath ground level 14 and includes a water inlet 16 and water outlet 18.

A water elevator 20 extends upwardly of outlet 18 of reservoir 12 to above ground level 14. Elevator 20 includes cylindrical shaft 22 having open ends 24 and 26. End 26 includes outlet 30 from which spout 32 extends. Spout 32 of elevator 20 is positioned over elevated tank 62. A platform 34 is positioned within shaft 22 and slidably engages the shafts inner wall 25. Seal means (not shown) are positioned along the outer edge of platform 34 to guard against leakage. Platform 34 defines a central opening 36 preferably having a downwardly tapered side wall 37. A buoyant valve or plunger 38 with stem 39 is positioned within opening 36 of platform 34 and has a converging peripheral wall which corresponds with opening 36. Elevator 20 further includes a balloon 40 connected via cable 42 to platform 34. Cable 34 is threaded through pulley 44 which is supported by pulley support 46, and is further threaded through pulley 48 which is supported by elevated pulley support 50. Balloon 40 includes an inlet/-outlet 52 to which one end of a flexible hose 54 is connected. The other end of hose 54 is connected to a pump 56 which is connected via tube 58 to a buoyant gas (preferably helium) storage tank 60.

Elevated tank 62 is supported above ground level 14 by a stand or tower structure 68 and includes an outlet 66. A conduit 70 is connected between outlet 66 and a turbine generator 72. Turbine generator 72 is a type as is typical in the industry and does not constitute a point of novelty of this invention. Generator 72 typically includes inlet 74, outlet 76, internal impellers (not shown) in flow communication with ports 74 and 76 and connected to a rotating armature (not shown). Generator 72 also includes electrical output terminals 78. A conduit 80 is connected in flow communication between outlet 76 of generator 72 and inlet 16 of storage tank 12.

The hydroelectric generator of FIG. 1 operates in the following manner. Initially, balloon 40 is deflated, reservoir 12 contains water 13, platform 34 is submersed in the water and is suspended above reservoir bottom wall 17 atop an inwardly extending lip 25 of shaft 22. Stem 39 of valve 38 contacts bottom wall 17 with valve 38 floating above opening 36. Tank 62 is initially empty, so that no water flows through generator 72 to allow production of electricity.

A two-way valve (not shown) associated with pump 56 is opened to allow buoyant gas from storage tank 60 to flow under pressure into balloon 40 via flexible tube 54. As balloon 40 inflates, platform 34 is lifted via cable 42 drawn over pulleys 44, 48. As platform 34 is lifted, water 13 pushes downward on valve 38 which lowers into opening 36 to seal the opening. As balloon 40 continues to fill with gas it continues to rise and lift platform 34 and the column of water. When the column of water reaches outlet port 30 of shaft 22, it empties into tank 62 via spout 32. The water in tank 62 flows via outlet 66 and conduit 70 to inlet 74 of generator 72 to turn the impeller blades (not shown) which subsequently turn the armature (not shown) of generator 72 to produce electricity. Water exits the generator via outlet port 76 and flows through conduit 80 through inlet port 16 and into tank 12. Thus, the water in the system operates in a closed loop with little or no loss.

In order for apparatus 10 to continue to produce electricity, platform 34 must be lowered to collect another column of water. After the initial volume of water empties into tank 62 and generator 72 begins to generate electricity, pump 56, which is connected to generator cables 78 by leads 79, and is powered by a portion of the electricity from generator 72, is activated and begins to draw helium from balloon 40 back into storage tank 60. The deflating of balloon 40 allows platform 34 and valve 38 to descend into tank 12. Upon valve stem 39 contacting reservoir bottom wall 17, valve 38 is urged above platform opening 36 thus allowing water to enter the shaft above the platform through the opening. As platform contacts the lip 25, pump 56 is deactivated and its valve (not shown) is reopened to again allow gas to flow into balloon 40. Apparatus 10 is therefore cyclical in nature, continually inflating and deflating balloon 40 to lift columns of water for generation of electricity as the water flows through turbine generator 72. Conventional control means, such as limit switches (not shown), positioned in cylinder 22 control the inflation and deflation of balloon 40.

Figure 2:
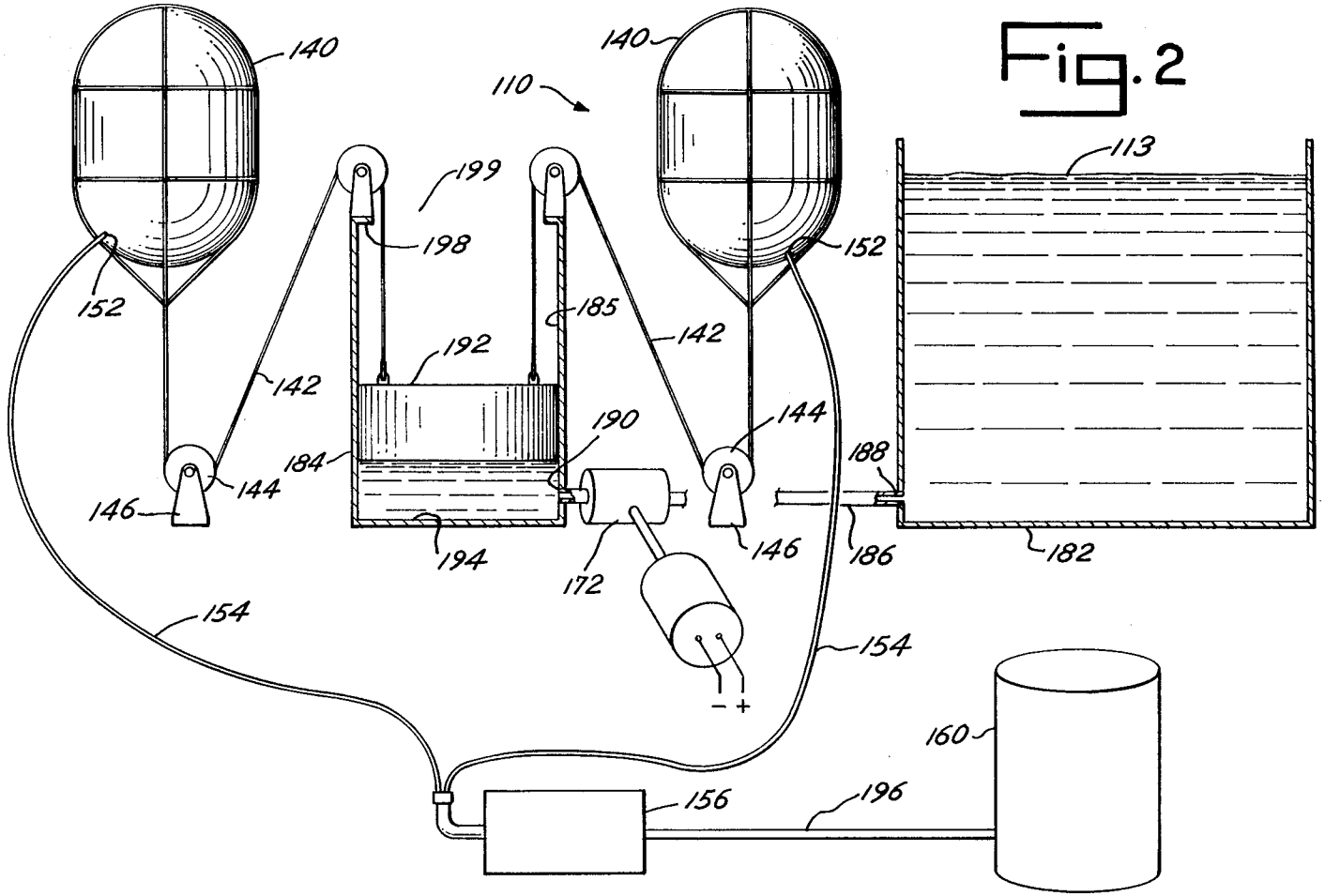
FIG. 2 is an elevational view of a second embodiment of the invention with some elements shown in cross-section for illustrative purposes.

A second embodiment of this invention is depicted in FIG. 2.

The helium hydroelectric generator 110 depicted in FIG. 2 includes a turbine generator 172 connected in flow communication between storage tank 182 and storage tank 184 via conduit 186. Tank 182 includes inlet/outlet 188 connected to pipe 186.

Tank 184 includes an inlet/outlet 190. Tank 184 further includes an opening 199 defined by inwardly extending lip 198. A weighted plunger 192 is slidably positioned within tank 184 and bears upon tank inner walls 185. Seal means (not shown) may be connected to plunger 192 to insure that no leakage occurs.

Plunger 192 is connected to balloons 140 by cables 142. Cables 142 extend over pulleys 144 which are supported by pulley supports 146. Each balloon 140 includes an inlet/outlet 152 for connection to one end of a flexible hose 154. The other end of hose 154 is connected to pump 156. A pipe 196 is connected between gas storage tank 160 and pump 156. Pump 156 includes a two-way valve (not shown) for directing the flow of gas between balloons 140 and tank 160.

Apparatus 110 operates in the following manner. Initially cylinder 184 is void of water, with plunger 192 resting on bottom wall 194 of cylinder 184, balloons 140 are deflated and turbine 172 is not producing electricity. As the pump valve (not shown) is opened, balloons 140 inflate with helium thereby lifting plunger 192. As plunger 192 is lifted, the suction force created by the displaced air in tank 184 as well as the weight of water 113 in tank 182 causes water from tank 182 to flow through conduit 186 and turbine generator 172 into tank 184. Upon the plunger 192 reaching the top of tank 184 and abutting lip 198, pump 156 is activated by conventional means such as a limit switch (not shown) and begins to pump the helium gas contained in balloon 140 back into storage tank 160 to deflate the balloon. Upon deflation of balloon 140, plunger 192 descends and thus forces water beneath the plunger back through turbine generator 172, conduit 186 and into tank 182. Plunger 192 continues its descent until it again rests upon the bottom of tank 184. Thus, as in the previous embodiment, apparatus 110 is cyclical in nature, continually inflating balloons 140 to raised plunger 192 and then deflating the balloons to lower the plunger. As plunger 192 is raised and lowered, water is forced between tanks 182 and through turbine generator 172 which produces electricity.

Figure 3:
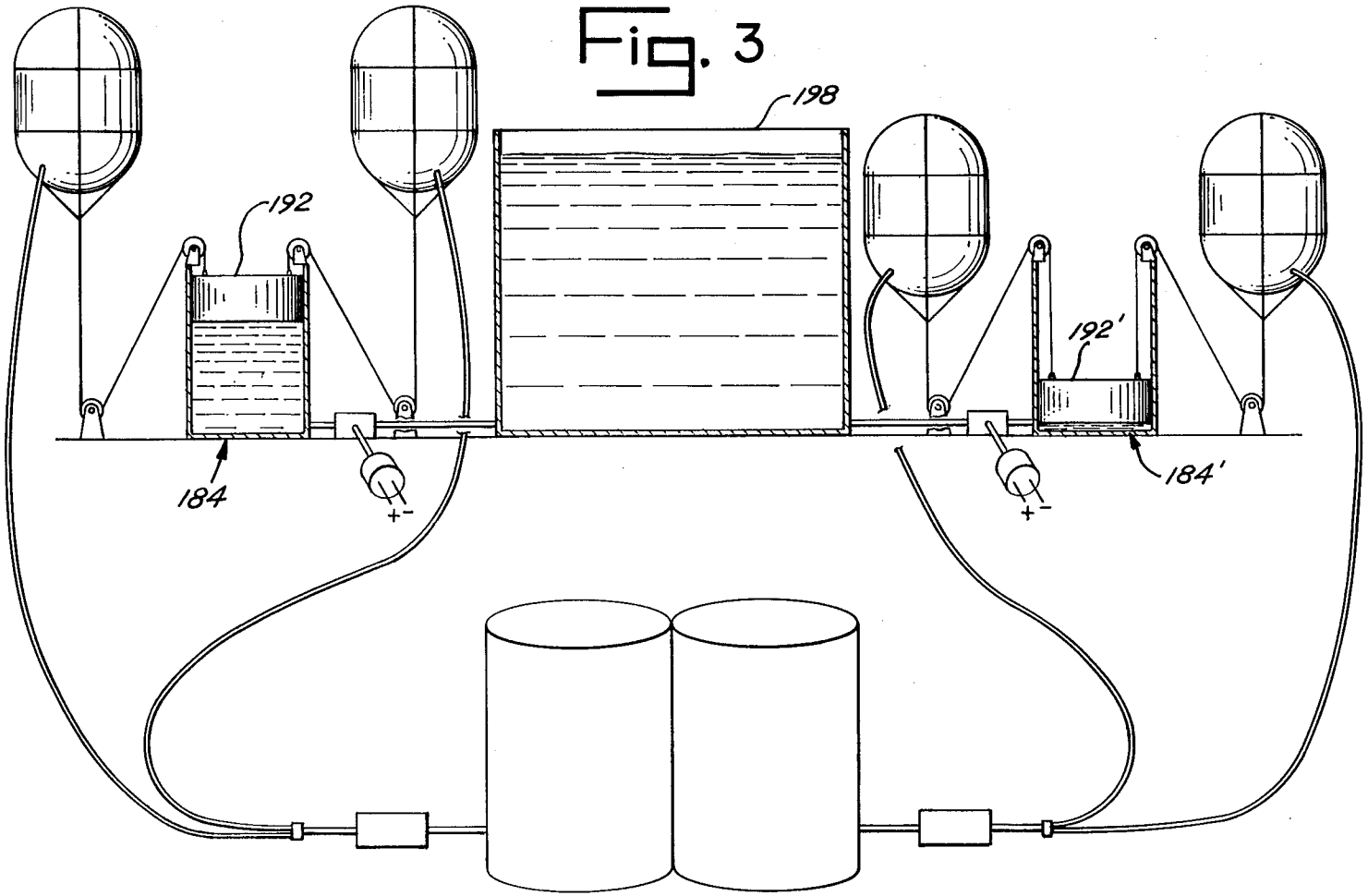
FIG. 3 is an elevational view of a third embodiment of the invention with some elements shown in cross-section for illustrative purposes.

An expanded version of the second embodiment is depicted in FIG. 3 which illustrates the possible staging of the hydroelectric generator depicted in FIG. 2. As shown in FIG. 3 two cylinders 184, 184' with individual plungers 192, 192' are connected to a large main storage tank 198. The plungers would be oriented such that as one plunger 192 was raised, the other plunger 192' would be lower. Therefore, the staged generator would be capable of providing a greater electrical output from generators 172 with only the addition of one cylinder 184' and its plunger assembly 192'.

It should be understood that while only one balloon is illustrated in FIG. 1 and two balloons in FIGS. 2 and 3, any number of balloons could be used to expand the lifting capabilities.

To clarify and as proof of practical functionality and viability of the presented invention and for purposes of proper perspective, the following calculations are included with reference to FIG. #1 only:

Choosing for the elevator lift four balloons of total 32,000 pounds, 453 grams per pound, giving use +14,496,000 grams, which @4 grams/per mole, at atmospheric pressure @22.4 liters volume expands to 81,177,600 liters. This volume equals $\times 2.2 = 1.7859 \times 10^8$ pints volume; 62.4 (pints/cu.ft.), =28,620,308 cubic foot, and as divided between four lift balloons, amounts to 715,507 cubic foot per balloon. This figure cubed would only amount to 89 $ft.^3$ or about 89 per side!

The mass density of Helium is 0.17847 compared to air of 1.2929, so Helium will balance at ordinary atmospheric pressure in this comparable ratio 7 times its own weight of mass, as in this instance is water. Choosing intermediate or average balloon lift force with 32,000 pounds of liquid weight of water of 1 to 6, or 1/6th of the force of gravity of 32 pounds/per second. (buoyancy being the reverse of gravity proportionally); this would lift 192,000 pounds of water at @ about 9.375 feet per second, or to the top of 300 feet in about 10 seconds. Let us say that it takes about double, or 20 seconds for one up and down alternating cycle to perform.

From 300 foot height of head waters we develop 57,600,000 foot pounds of work. Subtracting efficiency loss of turbine generator, we can use the amounts of 46,080,000 foot pounds, which translates into energy of 62,439 Kw. seconds. Divided by the time cycle of 20 seconds, this gives us 3122 Kw., seconds of energy output. The energy to pump in and out of the balloons of 32,000 pounds of work, or only 0.17–17% of the developed energy, which can be tapped off of the turbine generator output, of some 1300 Kilowatts leave a grand total of 1822 kilowatts available for utilities of 1822 people or consumers.

It should be further understood that the invention described will function so long as the balloons could be made less dense than the ambient surroundings.

I claim:

1. A device for producing electricity, said device including a fluid source, and a generator means in flow communication with said fluid source for converting mechanical energy into electricity, the improvement wherein said fluid source includes first and second storage members having a quantity of fluid contained within said first storage member, said first storage member being vertically spaced from said second storage member, conduit means connected between and in flow communication with said first and second storage members for directing a portion of said fluid from said first storage member to said second storage member, means for urging said fluid between said first and second storage members through said conduit means, said generator means in flow communication with said first and second storage members wherein said fluid flows through said generator upon moving said portion of said fluid from said first storage member to said second storage member through said conduit means, said urging means includes a fluid elevator, said elevator including platform means for lifting said portion of fluid from said first storage member, delivering said portion of fluid to said conduit means to direct the fluid into said second storage member, said fluid elevator connected to a flotation device, said flotation device having a rest state and a filled state, said fluid elevator platform means being lowered when the flotation device is in its rest state, said elevator platform being raised along with said portion of water when the flotation device is in its filled state.

2. The device of claim 1 wherein said gas is helium.

3. A device for producing electricity, said device including a fluid source, and a generator means in flow communication with said fluid source for converting mechanical energy into electricity, the improvement wherein said fluid source includes first and second storage members having a quantity of fluid contained within said first storage member, said first storage member being vertically spaced from said second storage member, conduit means connected between and in flow communication with said first and second storage members for directing a portion of said fluid from said first storage member to said second storage member, means for urging said fluid between said first and second storage members through said conduit means, said generator means in flow communication with said first and second storage members wherein said fluid flows through said generator upon moving said portion of fluid from said first storage member to said second storage member through said conduit means, said urging means includes a plunger slidably engaging the side walls of said second member, and a flotation device connected to said plunger for lifting said plunger upon said flotation device being filled with a gas having density less than that of the surrounding environment, with said plunger being lowered when said gas is removed from each flotation device to urge said fluid between said first and second storage members through said conduit means and generator means.

4. The device of claim 3 wherein said gas is helium.

* * * * *